US009135838B2

(12) United States Patent
Kline et al.

(10) Patent No.: US 9,135,838 B2
(45) Date of Patent: Sep. 15, 2015

(54) LARGE SCALE LED DISPLAY

(75) Inventors: Daniel S. Kline, Encinitas, CA (US); Matthew W. Shankle, Greenwood Village, CO (US); David F. Cox, Escondido, CA (US); James C. Lee, San Diego, CA (US); Sam R. Sarcia, San Diego, CA (US)

(73) Assignee: ADTI MEDIA, LLC, Temecula, CA (US)

( * ) Notice: Subject to any disclaimer, the term of this patent is extended or adjusted under 35 U.S.C. 154(b) by 322 days.

(21) Appl. No.: 13/052,912

(22) Filed: Mar. 21, 2011

(65) Prior Publication Data

US 2011/0221662 A1 Sep. 15, 2011

Related U.S. Application Data

(62) Division of application No. 12/001,315, filed on Dec. 11, 2007.

(51) Int. Cl.

| | |
|---|---|
| ***G09F 9/33*** | (2006.01) |
| ***G09F 9/302*** | (2006.01) |
| ***G09F 27/00*** | (2006.01) |
| ***G09G 3/22*** | (2006.01) |
| ***G09G 3/20*** | (2006.01) |

(52) U.S. Cl.

CPC ..... *G09F 9/33* (2013.01); *G09F 9/3026* (2013.01); *G09F 27/008* (2013.01); *G09G 3/2074* (2013.01); *G09G 3/22* (2013.01); *G09G 2380/06* (2013.01)

(58) Field of Classification Search

None

See application file for complete search history.

(56) References Cited

U.S. PATENT DOCUMENTS

| | | | | |
|---|---|---|---|---|
| 4,268,821 | A | | 5/1981 | DeSmet |
| 4,612,720 | A | * | 9/1986 | Manners-Smith et al. ..... 40/211 |
| 4,782,336 | A | | 11/1988 | Bailey |
| 4,887,074 | A | | 12/1989 | Simon et al. |
| 5,160,200 | A | | 11/1992 | Cheselske |
| 5,184,114 | A | | 2/1993 | Brown |

(Continued)

FOREIGN PATENT DOCUMENTS

| | | | |
|---|---|---|---|
| CN | 1438515 | A | 8/2003 |
| EP | 1550947 | A2 | 7/2005 |

(Continued)

OTHER PUBLICATIONS

Notification concerning transmittal of International Preliminary Report on Patentability (Chapter 1 of the Patent Cooperation Treaty) dated Jun. 3, 2011 in International Application No. PCT/US2009/063350; International Preliminary Report on Patentability dated May 24, 2011; and Written Opinion of the International Searching Authority.

(Continued)

*Primary Examiner* — Kathy Wang-Hurst
*Assistant Examiner* — David Tung
(74) *Attorney, Agent, or Firm* — Jerry R. Potts

(57) ABSTRACT

A large scale LED display has a cable and rigid link support structure for a number of LED modules. The cable and rigid link support structure is flexible but has sufficient structural integrity to prevent misalignment of the pixel modules. The LED modules are removable from the support structure individually and as a group so as to facilitate repair of the display. The LED modules are rugged so as to withstand harsh outdoor conditions and they provide sufficient luminescence for use in sunlight.

20 Claims, 12 Drawing Sheets

(56) References Cited

U.S. PATENT DOCUMENTS

| | | | | |
|---|---|---|---|---|
| 5,287,353 | A | 2/1994 | Buda et al. | |
| 5,317,344 | A | 5/1994 | Beaman et al. | |
| 5,406,176 | A | 4/1995 | Sugden | |
| 5,410,328 | A * | 4/1995 | Yoksza et al. | 345/82 |
| 5,420,482 | A | 5/1995 | Phares | |
| 5,424,925 | A | 6/1995 | Jenke et al. | |
| 5,523,769 | A | 6/1996 | Lauer et al. | |
| 5,564,819 | A | 10/1996 | Yamaguchi | |
| 5,636,303 | A | 6/1997 | Che et al. | |
| 5,882,105 | A | 3/1999 | Barlow | |
| 5,900,850 | A | 5/1999 | Bailey et al. | |
| 5,924,784 | A | 7/1999 | Chliwnyj et al. | |
| 6,009,650 | A | 1/2000 | Lamparter | |
| 6,016,038 | A | 1/2000 | Mueller et al. | |
| 6,104,414 | A | 8/2000 | Odryna et al. | |
| 6,118,426 | A | 9/2000 | Albert et al. | |
| 6,150,774 | A | 11/2000 | Mueller et al. | |
| 6,211,626 | B1 | 4/2001 | Lys et al. | |
| 6,269,565 | B1 | 8/2001 | Inbar et al. | |
| 6,362,801 | B1 * | 3/2002 | Yuhara | 345/82 |
| 6,394,623 | B1 | 5/2002 | Tsui | |
| 6,435,459 | B1 | 8/2002 | Sanderson et al. | |
| 6,461,008 | B1 * | 10/2002 | Pederson | 362/35 |
| 6,498,672 | B2 | 12/2002 | Saitoh | |
| 6,519,395 | B1 | 2/2003 | Bevan et al. | |
| 6,558,021 | B2 * | 5/2003 | Wu et al. | 362/235 |
| 6,608,453 | B2 | 8/2003 | Morgan et al. | |
| 6,737,983 | B1 * | 5/2004 | Temple | 340/815.45 |
| 6,777,891 | B2 | 8/2004 | Lys et al. | |
| 6,788,011 | B2 | 9/2004 | Mueller et al. | |
| 6,806,659 | B1 | 10/2004 | Mueller et al. | |
| 6,998,650 | B1 | 2/2006 | Wu | |
| 7,064,673 | B1 | 6/2006 | Bonham | |
| 7,071,620 | B2 * | 7/2006 | Devos et al. | 313/512 |
| 7,221,104 | B2 | 5/2007 | Lys et al. | |
| 7,253,566 | B2 | 8/2007 | Lys et al. | |
| 7,295,199 | B2 | 11/2007 | Foo et al. | |
| 7,319,408 | B2 | 1/2008 | Temple | |
| 2002/0110000 | A1 | 8/2002 | Marcus | |
| 2002/0122309 | A1 | 9/2002 | Abdelhafex et al. | |
| 2003/0058191 | A1 * | 3/2003 | Yuhara et al. | 345/44 |
| 2003/0112204 | A1 | 6/2003 | Pettersen | |
| 2003/0117347 | A1 | 6/2003 | Hunter et al. | |
| 2003/0146882 | A1 | 8/2003 | Ogino et al. | |
| 2004/0008155 | A1 | 1/2004 | Cok | |
| 2004/0080938 | A1 | 4/2004 | Holman et al. | |
| 2004/0095763 | A1 | 5/2004 | Guerrieri et al. | |
| 2005/0052374 | A1 | 3/2005 | Devos et al. | |
| 2005/0052375 | A1 | 3/2005 | Devos et al. | |
| 2005/0093768 | A1 | 5/2005 | Devos et al. | |
| 2005/0168424 | A1 * | 8/2005 | Nakamoto et al. | 345/89 |
| 2005/0259034 | A1 * | 11/2005 | Harada et al. | 345/7 |
| 2006/0022214 | A1 | 2/2006 | Morgan et al. | |
| 2006/0039142 | A1 * | 2/2006 | Temple | 362/231 |
| 2006/0104086 | A1 * | 5/2006 | Ura | 362/600 |
| 2006/0132048 | A1 | 6/2006 | Popovich | |
| 2006/0227003 | A1 * | 10/2006 | Ven | 340/815.45 |
| 2007/0015396 | A1 * | 1/2007 | Mrakovich et al. | 439/417 |
| 2007/0041190 | A1 * | 2/2007 | Chou | 362/252 |
| 2007/0041220 | A1 | 2/2007 | Lynch | |
| 2007/0115666 | A1 | 5/2007 | Thomas et al. | |
| 2007/0211184 | A1 | 9/2007 | Erchak et al. | |
| 2008/0123367 | A1 | 5/2008 | Pan | |
| 2008/0244944 | A1 | 10/2008 | Nall et al. | |
| 2009/0121988 | A1 * | 5/2009 | Amo et al. | 345/82 |
| 2009/0146917 | A1 | 6/2009 | Kharrati et al. | |
| 2009/0146918 | A1 | 6/2009 | Kline et al. | |
| 2009/0146919 | A1 | 6/2009 | Kline et al. | |
| 2009/0146931 | A1 | 6/2009 | Kharrati et al. | |
| 2009/0147028 | A1 | 6/2009 | Sefton | |
| 2011/0215992 | A1 | 9/2011 | Kline et al. | |

FOREIGN PATENT DOCUMENTS

| | | | |
|---|---|---|---|
| GB | 2143983 | | 2/1985 |
| GB | 2240686 | A | 7/1991 |
| JP | H01113280 | U | 7/1989 |
| JP | H01113285 | U | 7/1989 |
| JP | H0295109 | A | 4/1990 |
| JP | H02278282 | A | 11/1990 |
| JP | H04186276 | A | 7/1992 |
| JP | H1195715 | A | 4/1999 |
| JP | 2000012906 | A | 1/2000 |
| JP | 2008052238 | A | 3/2008 |
| WO | WO/2007/131344 | | 11/2007 |
| WO | 2007138494 | A1 | 12/2007 |
| WO | 2009076116 | | 6/2009 |
| WO | 2010059431 | A1 | 5/2010 |

OTHER PUBLICATIONS

European Search Report dated Jan. 27, 2010, Reference No. P91157EP00, Application No./Patent No. 05789062.6-1231 / 1784799 PCT/US2005029599.

International Searching Authority, International Search Report and Written Opinion of the International Searching Authority, International Application No. PCT/US2009/063350, Jan. 12, 2010.

Extended European Search Report dated Dec. 7, 2010, Application No. EP-08858504, Supplementary European Search Report and European Search Opinion.

Extended European Search Report dated Dec. 7, 2010, Application No. EP-08859575, Supplementary European Search Report and European Search Opinion.

International Bureau, International Preliminary Report on Patentability and Written Opinion of the International Searching Authority, dated Jun. 24, 2010, International Application No. PCT/US2008/085320.

International Bureau, International Preliminary Report on Patentability and Written Opinion of the International Searching Authority, dated Jun. 24, 2010, International Application No. PCT/US2008/085315.

International Bureau, International Preliminary Report on Patentability and Written Opinion of the International Searching Authority, dated Jun. 24, 2010, International Application No. PCT/US2008/085313.

International Bureau, International Preliminary Report on Patentability and Written Opinion of the International Searching Authority, dated Jun. 24, 2010, International Application No. PCT/US2008/085316.

International Searching Authority, International Search Report and Written Opinion of the International Searching Authority, dated Jan. 30, 2009, International Application No. PCT/US/2008/85315.

International Searching Authority, International Search Report and Written Opinion of the International Searching Authority, dated Feb. 3, 2009, International Application No. PCT/US/2008/85316.

International Searching Authority, International Search Report and Written Opinion of the International Searching Authority, dated Feb. 5, 2009, International Application No. PCT/US/2008/85320.

International Searching Authority, International Search Report and Written Opinion of the International Searching Authority, dated Feb. 9, 2009, International Application No. PCT/US/2008/85313.

Chinese Foreign Search Report corresponding to CN 2008801265197, Feb. 6, 2013, 4 pages.

Communication with European Search Report and Search Opinion corresponding to EP08859136, Sep. 6, 2013, 4 pages.

* cited by examiner

LARGE SCALE LED DISPLAY

CROSS-REFERENCE TO RELATED APPLICATIONS

The present application is a DIVISION of U.S. application Ser. No. 12/001,315, filed Dec. 11, 2007.

The present application is related to U.S. application Ser. No. 12/001,277, filed Dec. 11, 2007; U.S. application Ser. No. 12/001,312, filed Dec. 11, 2007; and U.S. application Ser. No. 12/001,276, filed Dec. 11, 2007.

The present application is also related to U.S. application Ser. No. 12/273,884, filed Nov. 19, 2008 and U.S. application Ser. No. 13/052,839, filed Mar. 21, 2011.

STATEMENT REGARDING FEDERALLY SPONSORED RESEARCH OR DEVELOPMENT

N/A

TECHNICAL FIELD

The present invention is directed to a large scale display and more particularly to the LED modules, segments and support structure for a large scale LED display.

BACKGROUND OF THE INVENTION

Large scale displays on the order of 10×20 ft. or 40×60 ft. are known to employ a net formed of intersecting cables to structurally support a number of pixel units as shown in Temple U.S. Patent Application Publication No. US 2006/0039142 A1. Because of its flexible nature, this net display may be supported on curved or irregular surfaces as well as flat surfaces. However, this net display is so flexible that the pixel units can twist about the cables, impairing the visibility of the pixels. Moreover, the horizontal cables of the net flex so that the pixel units become misaligned resulting in distortions in the displayed image. The pixel units of this net display include a housing for a circuit board that supports a cluster of red, green and blue LEDs wherein a potting material seals the circuit board from the environment. U.S. patent Yoksza et al. U.S. Pat. No. 5,410,328 shows similar pixel modules for a large scale LED display wherein each module is individually removable from the display by removing a few screws or twisting the module. One wall of the housing of the pixel module in Yoksza et al. extends beyond the LEDs so as to provide a sunshade for the module. Another LED module for a display, as shown in Simon et al. U.S. Pat. No. 4,887,074, uses a heat sinking potting compound in contact with the circuit board supporting the LEDs and heat spreader plates to dissipate heat from the module housing.

BRIEF SUMMARY OF THE INVENTION

In accordance with the present invention, the disadvantages of prior art large scale LED displays have been overcome. The LED display system of the present invention includes a novel support structure for a number of LED modules wherein the support structure is sufficiently flexible so that the display can conform to curved or irregular surfaces and yet the support structure has sufficient structural integrity to prevent twisting and sagging of the LED modules, preventing misalignment of the modules so that a distortion free image can be displayed.

In accordance with one feature of the present invention, the display includes a plurality of LED modules wherein each LED module includes a module housing that supports a plurality of color LEDs. The support structure for the LED modules includes a first pair of parallel cables; a first set of rigid links, extending between the cables of the first cable pair; a second pair of parallel cables, the cables of the second cable pair being parallel to the cables of the first cable pair; and a second set of rigid links extending between the cables of the second cable pair wherein each of the LED modules is mounted on one cable of the first cable pair and one cable of the second cable pair.

In accordance with another feature of the present invention, the rigid links are H-shaped links that are over-molded onto a pair of cables. The links are such that they locate the position of the LED modules along the cables.

In accordance with another feature of the present invention, the support structure includes a plurality of plates wherein the plates are mounted on one cable of the first cable pair adjacent to at least one rigid link of the first set and on one cable of the second cable pair adjacent to at least one link of the second set wherein a LED module is removably mounted on a plate.

In accordance with still a further feature of the present invention, a LED module for a display includes at least two red LEDs; two green LEDs; two blue LEDs; a circuit board on which the LEDs are mounted and an over-molded housing encasing the circuit board, the LEDs protruding from a front surface of the housing and the front surface of the housing including a plurality of heat sink fins.

In accordance with another feature of the present invention, a LED display comprises a plurality of linear segments of LED modules in each of a plurality of columns or rows of the display, each LED module having a housing supporting a plurality of multi-color LEDs and each segment including a plurality of LED modules coupled together so that the LED modules of a segment are removable from the display only as a group and each segment of LED modules is removable from the display independent of the LED modules of another segment. In this embodiment the LED display may include individual LED modules that are connected between segments of LED modules.

In accordance with another feature of the present invention, a segment of LED modules for use in a display comprises a first electrical connector fixedly attached to a first end of the segment; a second electrical connector fixedly attached to a second end of the segment; a plurality of spaced LED modules connected between the first electrical connector and the second electrical connector, the spaced LED modules being connected end-to-end by at least one cable capable of carrying power and/or data to each of the LED modules; and a further cable connected directly between the first connector and the second connector for carrying data directly between the first and second connectors.

These and other advantages and novel features of the present invention, as well as details of an illustrated embodiment thereof, will be more fully understood from the following description and drawings.

DETAILED DESCRIPTION OF THE INVENTION

Figure 1:
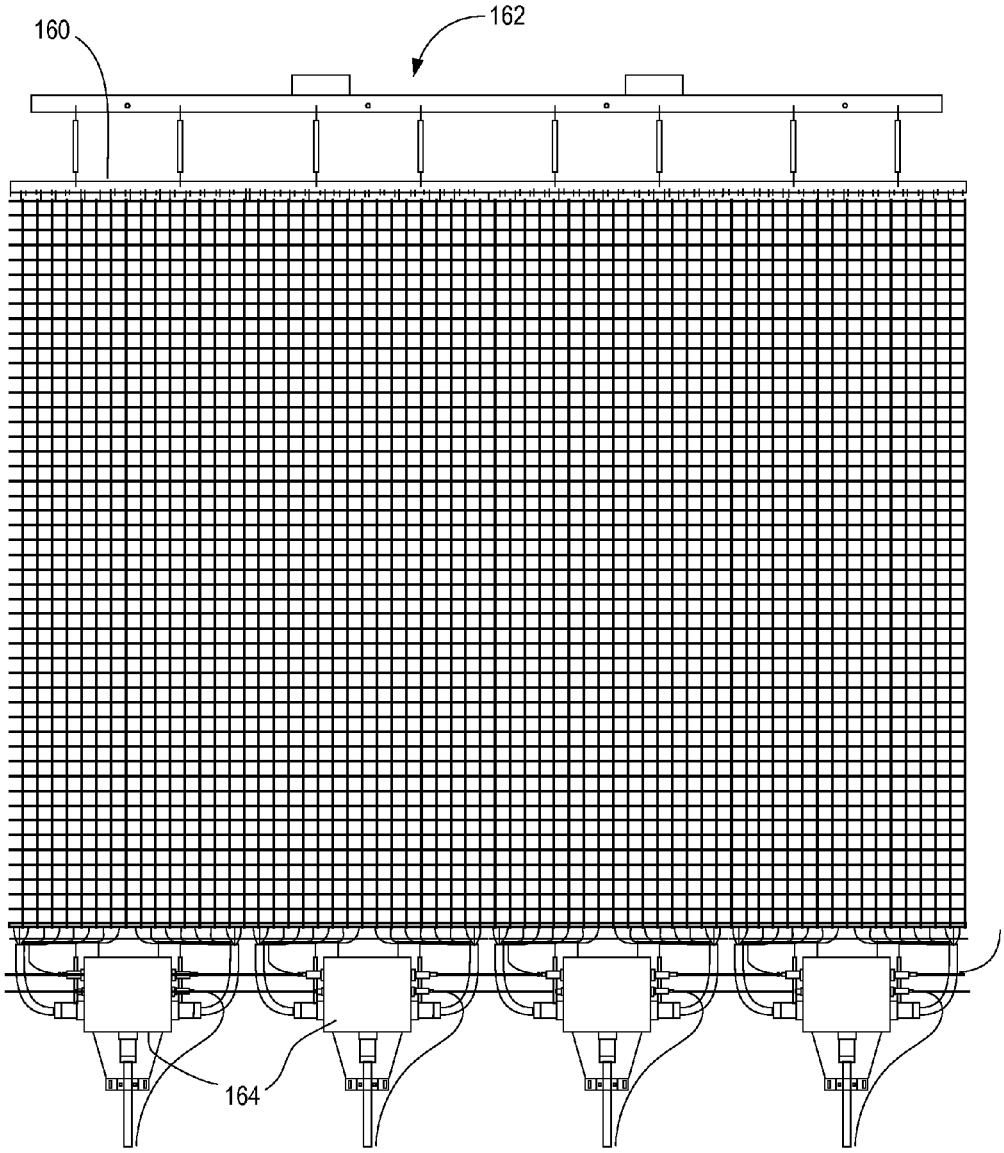
FIG. 1 is a front view of a large scale display in accordance with one embodiment of the present invention.

A large scale LED display 10 in accordance with the present invention, as shown in FIG. 1, has height by width dimensions on the order of 3 m×6 m to 24 m×32 m or approximately 10 ft.×20 ft. to 80 ft.×105 ft. However, it should be appreciated, that the present invention can be used for displays that are larger or smaller as well. A display that is approximately 24 m×32 m has 480 pixels×640 pixels or a total of 307,200 pixels. These large scale LED displays are intended for both indoor use and outdoor use. The large scale display in accordance with the present invention is extremely robust and can withstand harsh outdoor environments while providing distortion free displayed images. Moreover, segments of the display can be readily replaced.

Figure 2:
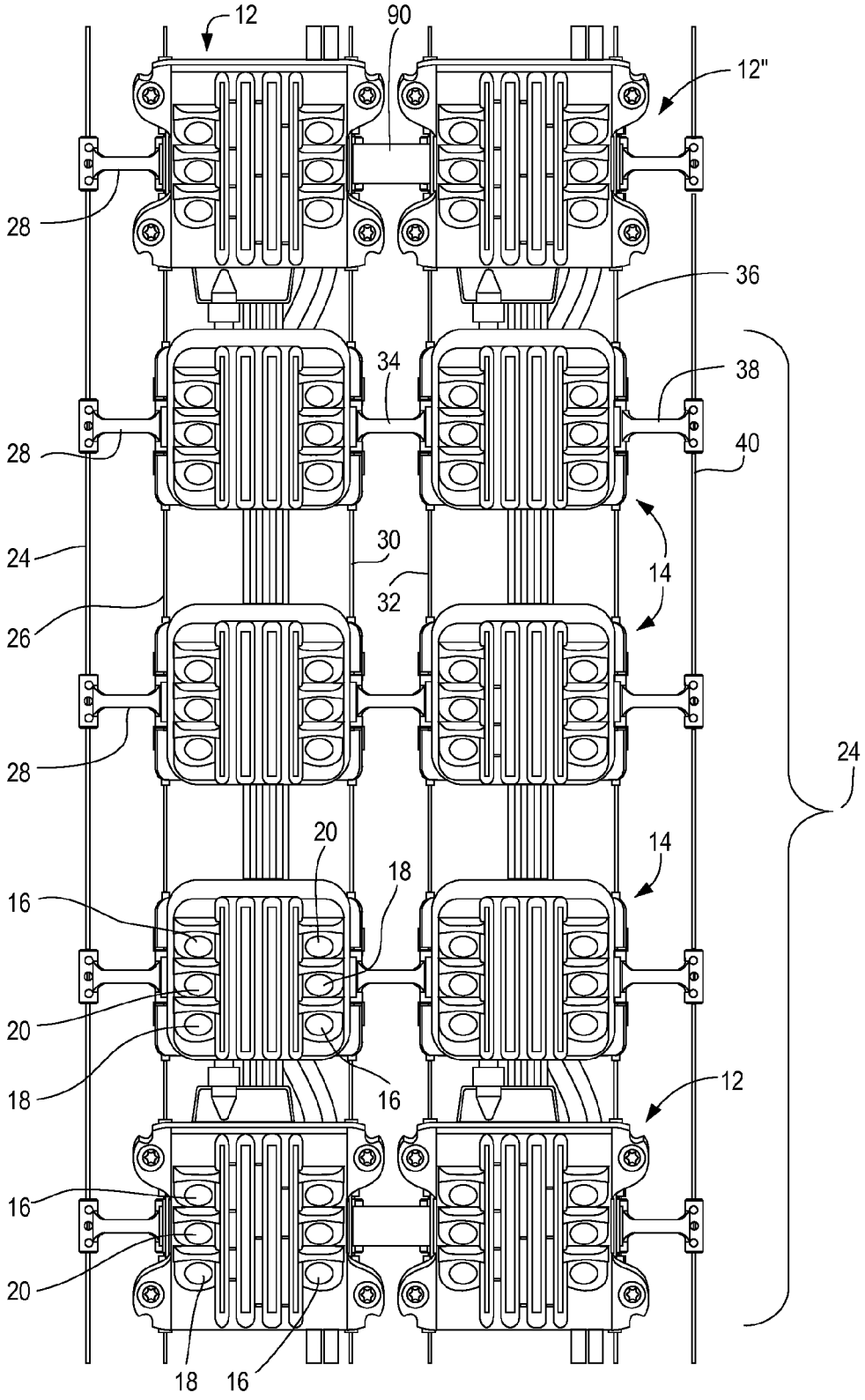
FIG. 2 is a partial front view of the display of FIG. 1, illustrating a number of LED modules mounted on the support structure for the display of the present invention.

Each pixel of the display 10 is generated by a module 12 or 14 having two red LEDs 16, two blue LEDs 18 and two green LEDs 20 mounted in a respective housing of the modules 12 or 14 as shown in FIG. 2. A circuit board contained within the housings of the modules 12 and 14 controls the intensities of the red, blue and green LEDs in order to generate pixels of a large number of different colors as is well known in the art. Although each of the modules 12 and 14 is depicted in FIG. 2 having pairs of red, green and blue LEDs, the number of red, green and blue LEDs can vary depending upon the spacing between the individual modules and the flux density of the individual LEDs. For example, where the center-to-center spacing between adjacent LED modules is 50 mm or greater, one or more red, one or more blue and one or more green LEDs can provide a light output for the display of 5,000 nits or greater depending upon the flux density of the LEDs so that the display 10 is suitable for use outdoors in sunlight. For a display in which the center-to-center spacing between adjacent LED modules is 75 mm or greater, it is preferable to use a plurality of red LEDs, a plurality of green LEDs and a plurality of blue LEDs, such as three LEDs of each color, although the number of LEDs may be reduced depending upon the flux density of the individual LEDs. It should be appreciated that all of the LEDs of the modules as well as the entire display may be monochromatic as well. When monochromatic LEDs are used, changeable graphics and/or text can be displayed by turning on selected LEDs or modules. Moreover, to enhance the light output of the modules, it is preferred that the housing of each of the modules be black or a dark color as described in detail below. In accordance with another feature of the invention, however, the color of the housing is selected to match the color of the structure, such as a building, on which the display is mounted. Moreover, a single display can employ modules with different colored housings so that when the LEDs of the display are turned off, the different colored housings depict a fixed logo, graphic and/or text message.

There are two types of pixel modules employed in the display 10, master LED modules 12 and slave LED modules 14. Each master module is associated with a group of slave modules in a segment 24 of the display. Although FIG. 2 illustrates a segment as including one master LED module and three slave LED modules for simplicity, in a preferred embodiment of the present invention, each segment has one master module and fifteen slave modules to generate sixteen pixels of the display. It should be apparent, however, that the number of slave modules can vary from zero to any number depending upon the aspects of the present invention that are used. In a preferred embodiment, the segments 24 of the display 10 are linear, extending in a column of the display 10. However, segments can extend in rows of the display as well. For a 480×640 display having linear segments of sixteen pixels, there are thirty segments in each column of the display. The segments are preferably aligned so that each master module is in a row of master modules. As such, there are thirty rows of master modules with 640 master modules in each row of a 480×640 display with fifteen rows of slave modules between each of the rows of master modules.

The support structure for each of the LED modules 12 and 14 of the display 10, as shown in FIGS. 2-5, includes a first pair of parallel cables 24 and 26 and a first set of rigid links 28 wherein each link 28 extends between the cable 24 and the cable 26. The support structure for each of the LED modules 12 and 14 also includes a second pair of parallel cables 30 and 32 and a second set of rigid links 34 wherein each link 34 extends between the cable 30 and the cable 32. Each of the LED modules in a first column of the display 10 is mounted on one cable 26 of the first cable pair and on one cable 30 of the second cable pair adjacent at least one link 28 from the first set and adjacent at least one link 34 from the second set. Each of the LED modules in the second column of the display 10 is mounted on the second cable 32 of the second cable pair and a cable 36 adjacent at least one link 34 of the second set of links and adjacent at least one link 38 in a third set of links that extends between cables 38 and 40 of a third cable pair. For a display having N columns, the support structure includes N+1 pairs of cables, such as cables 24 and 26, and N+1 sets of rigid links. If the display has M LED modules in each column, each set of links would include M links.

In a preferred embodiment, the links 28, 34, 38 are H-shaped links that are over-molded onto the cables of each cable pair. More specifically, the two cables of a cable pair are placed in a mold into which plastic is injected around the cable to form the rigid H-shaped links connecting the two cables of a pair. A reel to reel molding process is employed in which the over-molded links are indexed through the mold and the previously molded links are used to datum and position the subsequent links. The molding process ensures that the spacing between the links along the length of the cables is constant. The H-shaped links are used to precisely and easily locate the LED modules along the lengths of the cables so that the spacing between the LED modules in a column and the spacing between the LED modules in a row of the display 10 remains constant. Moreover, the H-shaped links provide structural integrity to the cable support structure of the display 10 to prevent sagging and misalignment of the LED modules when the display is in use. It is noted that the cables are preferably steel cables that are of a gauge sufficient to bear the load of all of the LED modules in a column of the display 10.

Figure 3:
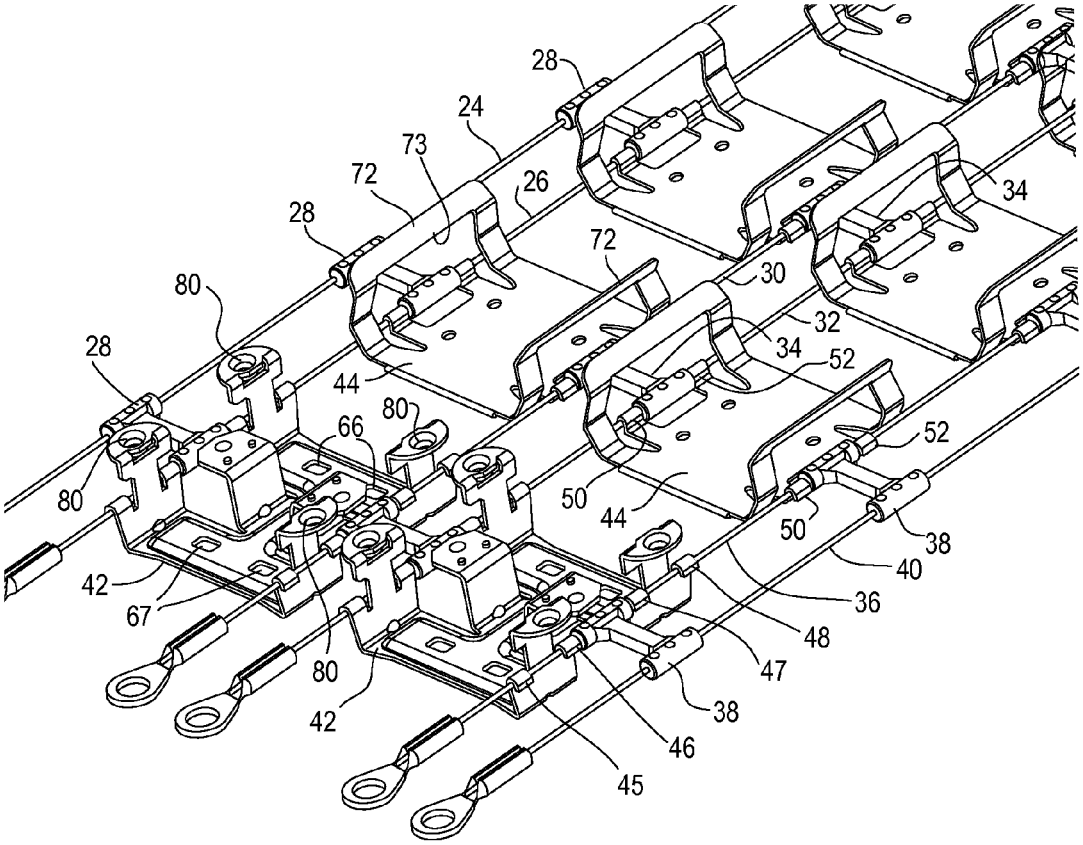
FIG. 3 is a partial perspective view of the support structure for the display of FIGS. 1 and 2.
Figure 4:
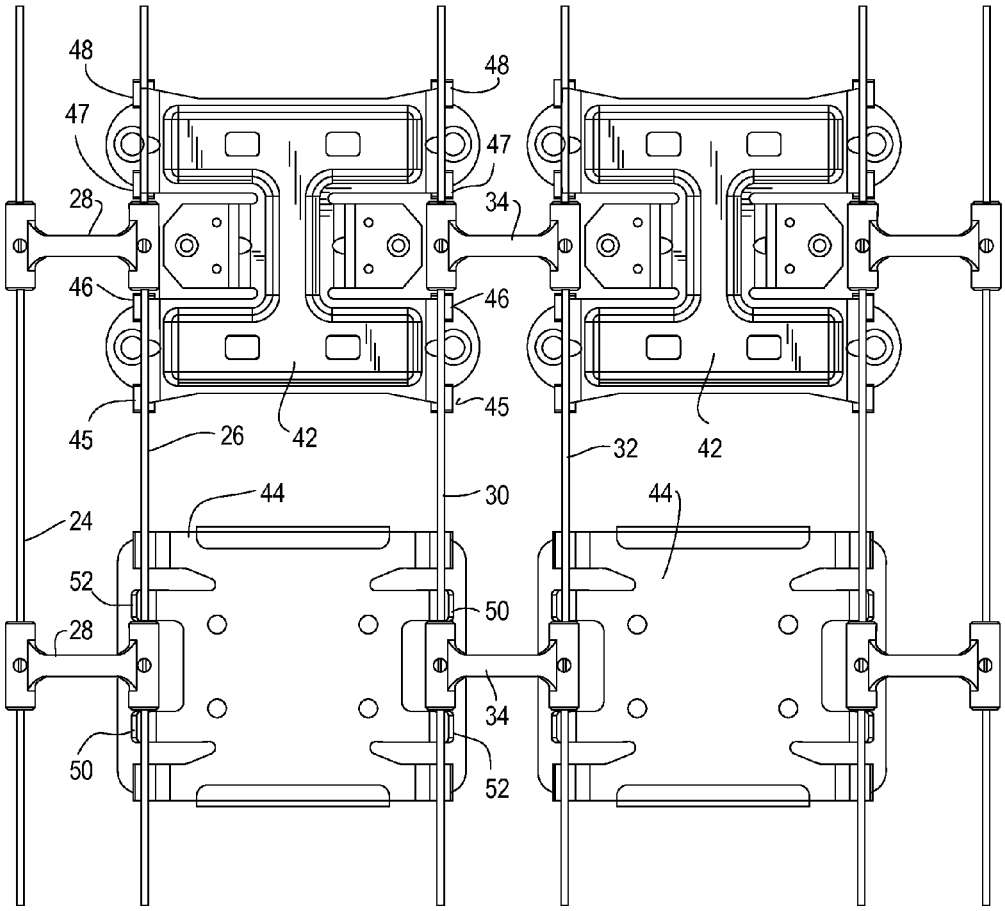
FIG. 4 is a back view of the support structure depicted in FIG. 3.
Figure 5:
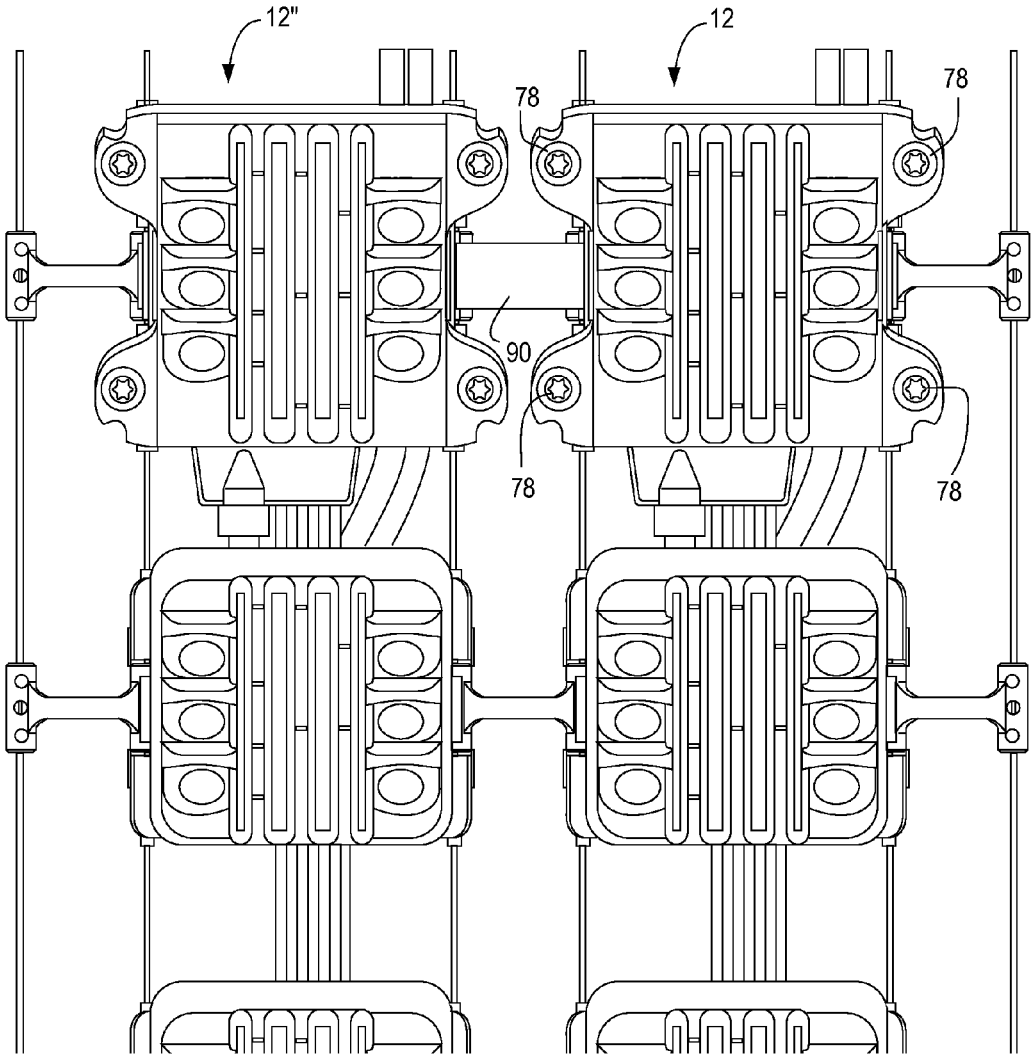
FIG. 5 is a partial front view of a pair of master LED modules and a pair of slave LED modules mounted on the support structure depicted in FIGS. 2-4.

More particularly, as depicted in FIGS. 3 and 4, the rigid H-shaped links serve to locate steel back plates 42 of the master LED modules 12 and steel back plates 44 of the slave LED modules 14. The back plate 42 of each of the master LED modules has four arms 45-48 on each side of the plate 42 wherein the arms 45-48 are crimped onto the cables of the support structure. The two inner arms 46 and 47 of the back plate 42 are crimped onto a respective cable on either side of a leg of the H-link 38 such that the arms 46 and 47 abut the H-link with some tolerance therebetween. Similarly, the back plate 44 of the slave LED modules has two arms 50 and 52 on each side of the plate 44 wherein the arms 50 and 52 are crimped onto the cables of the support structure on either side of the H-link such that the arms 50 and 52 abut the H-link with some tolerance therebetween. Because the arms of the back plates 42 and 44 of the LED modules are crimped onto the support cables of the display 10, the arms and thus the back plates can rotate somewhat about the cables to provide enough flexibility for the display 10 so that the display 10 can conform to curved surfaces even though the H-links cannot rotate about the cables. The rigid H-links and LED module back plates provide structural integrity for the support structure and prevent twisting, sagging and misalignment of the LED modules of the display 10. Moreover, the location of the links along the horizontal centerline of the back plates provides a structure that can be tensioned. This allows side tensioning of the mesh structure to cause the mesh to conform to a curved surface or to remove by tension any incidental wrinkles for a flat configuration.

Figure 6:
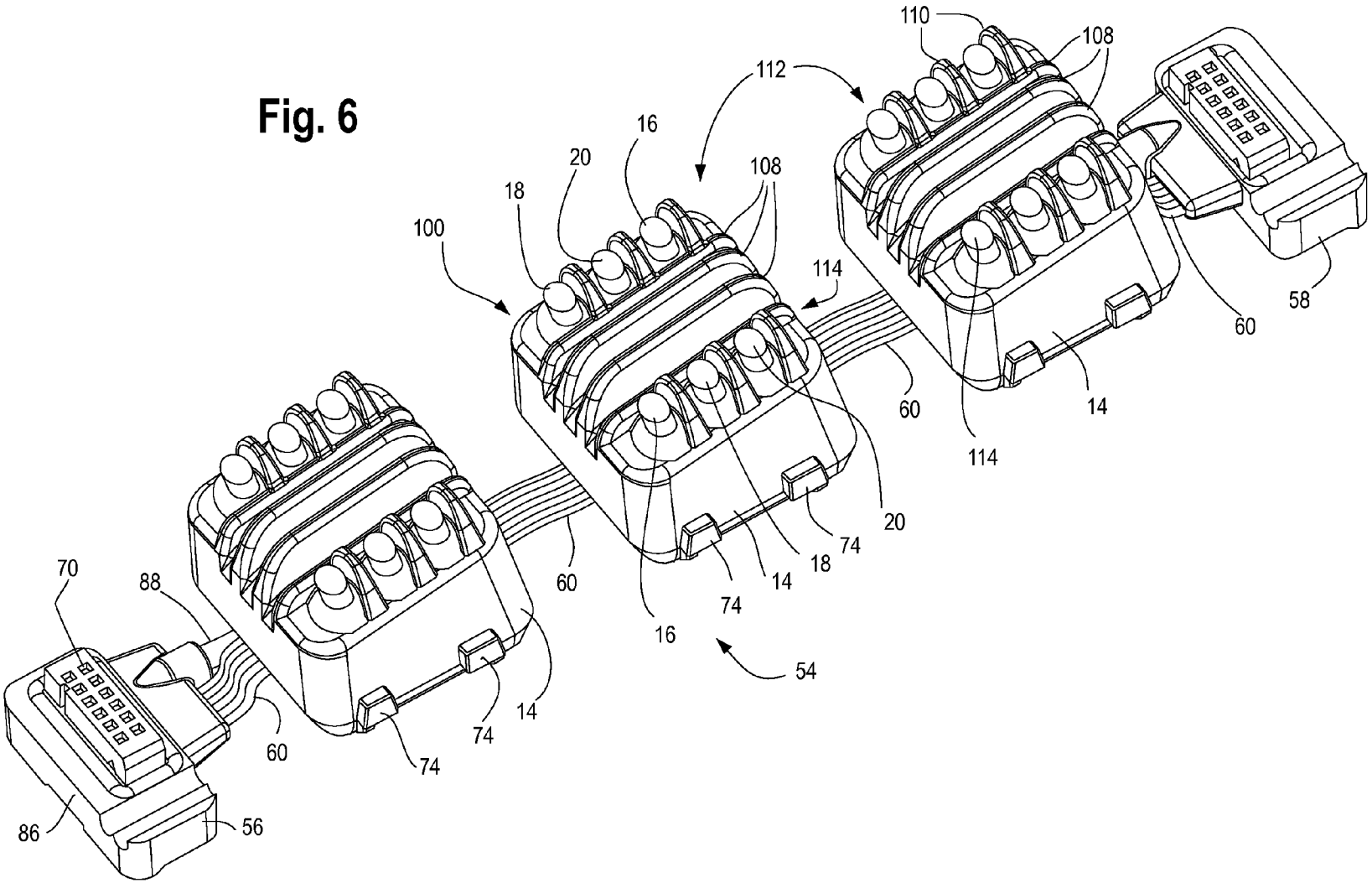
FIG. 6 is a perspective view of a segment of slave LED modules in accordance with one embodiment of the present invention.
Figure 7:
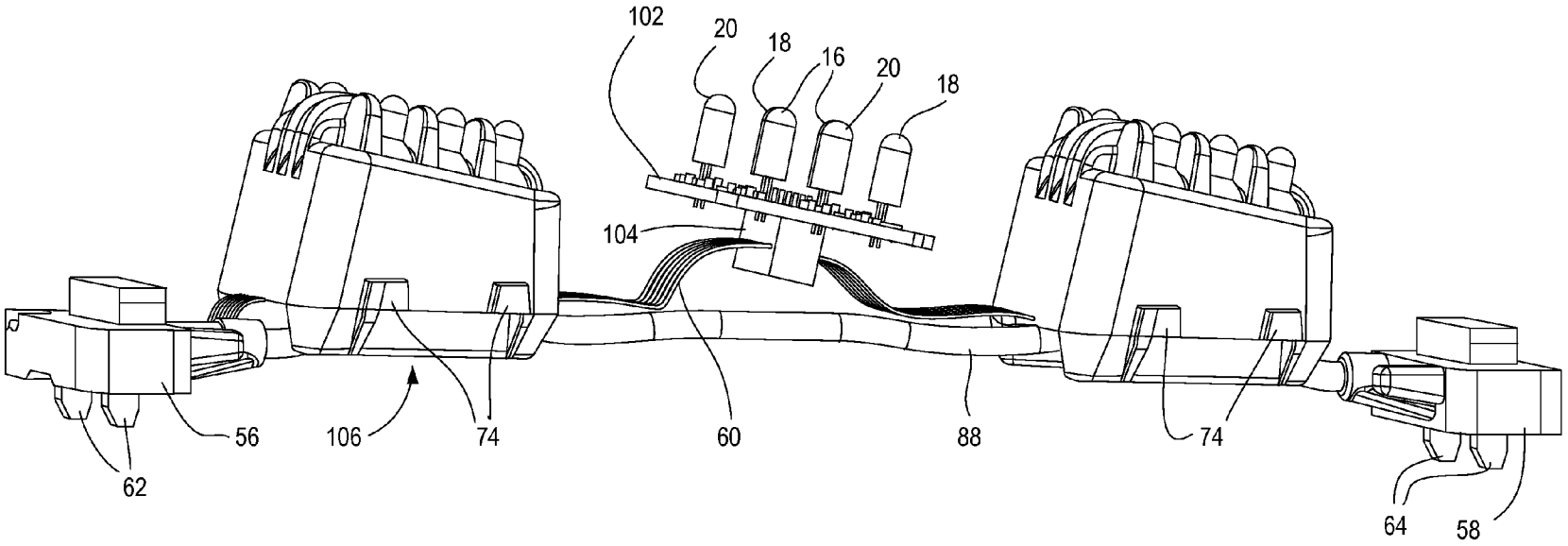
FIG. 7 is a side perspective view of the segment of slave LED modules depicted in FIG. 6 with the housing of one of the modules removed.
Figure 8:
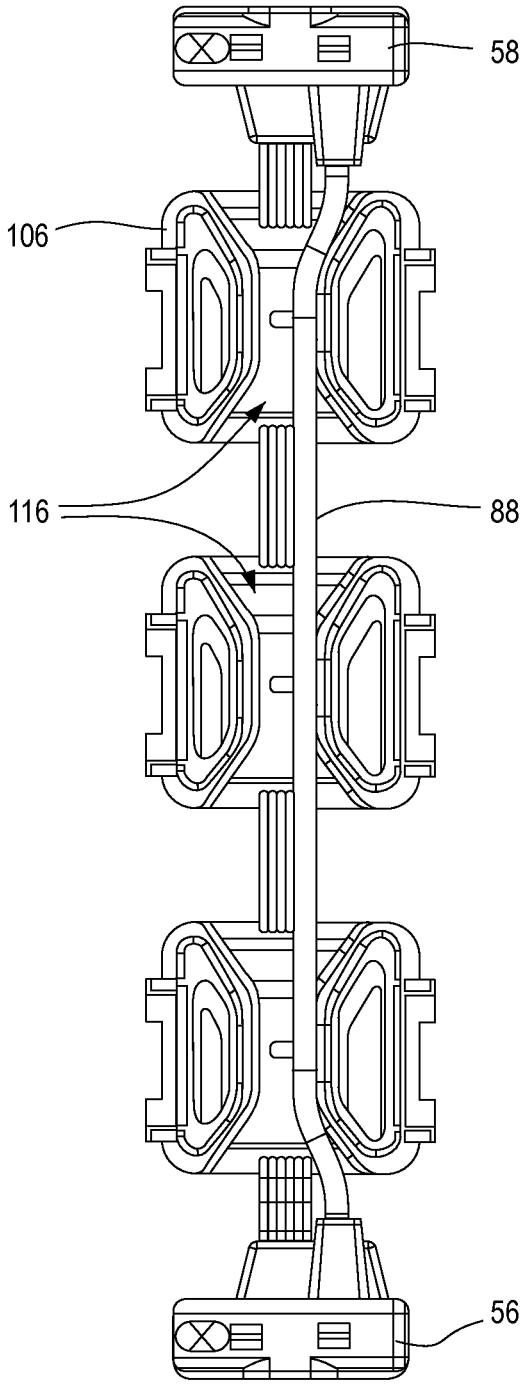
FIG. 8 is a back view of a segment of slave LED modules as depicted in FIG. 6.
Figure 9:
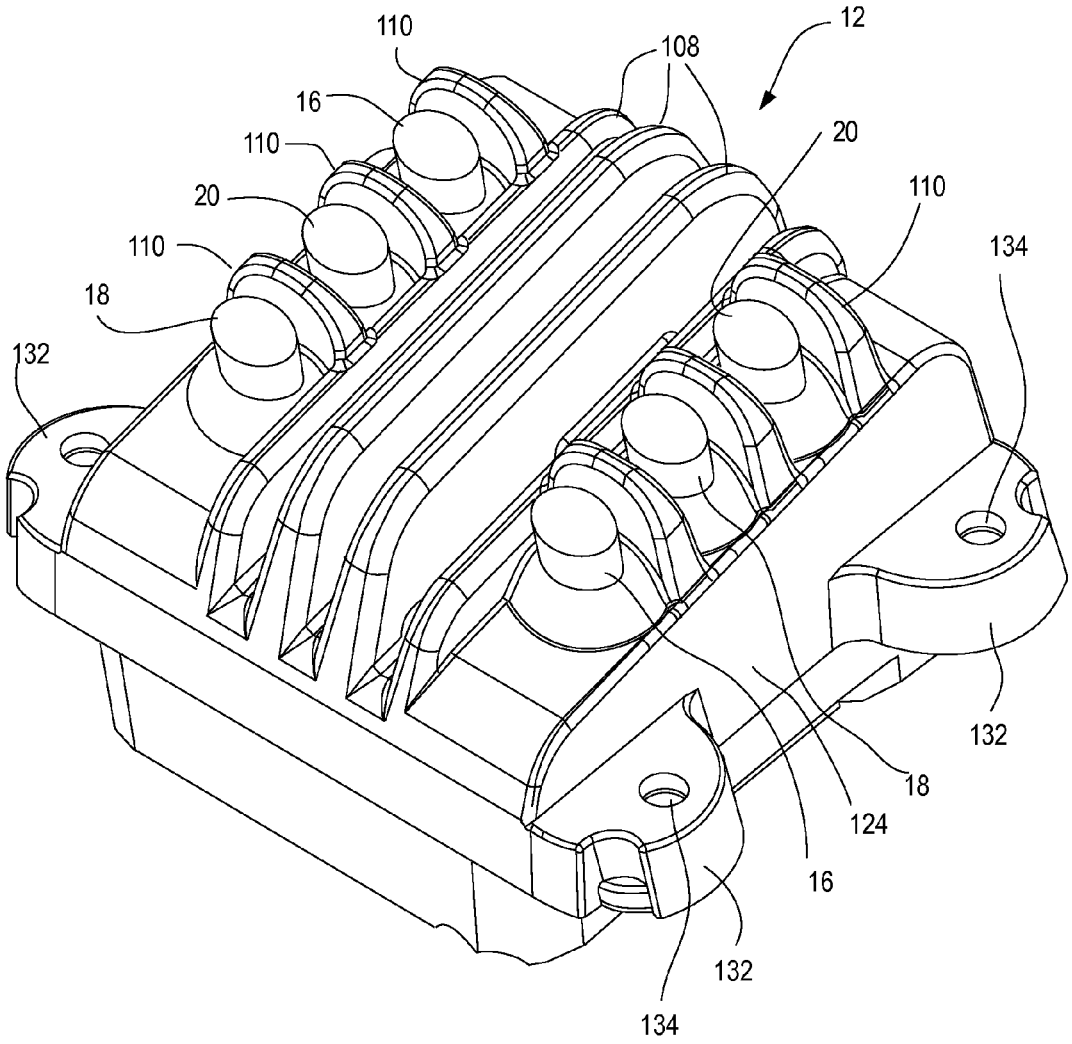
FIG. 9 is a front perspective view of a master LED module in accordance with one embodiment of the present invention.
Figure 10:
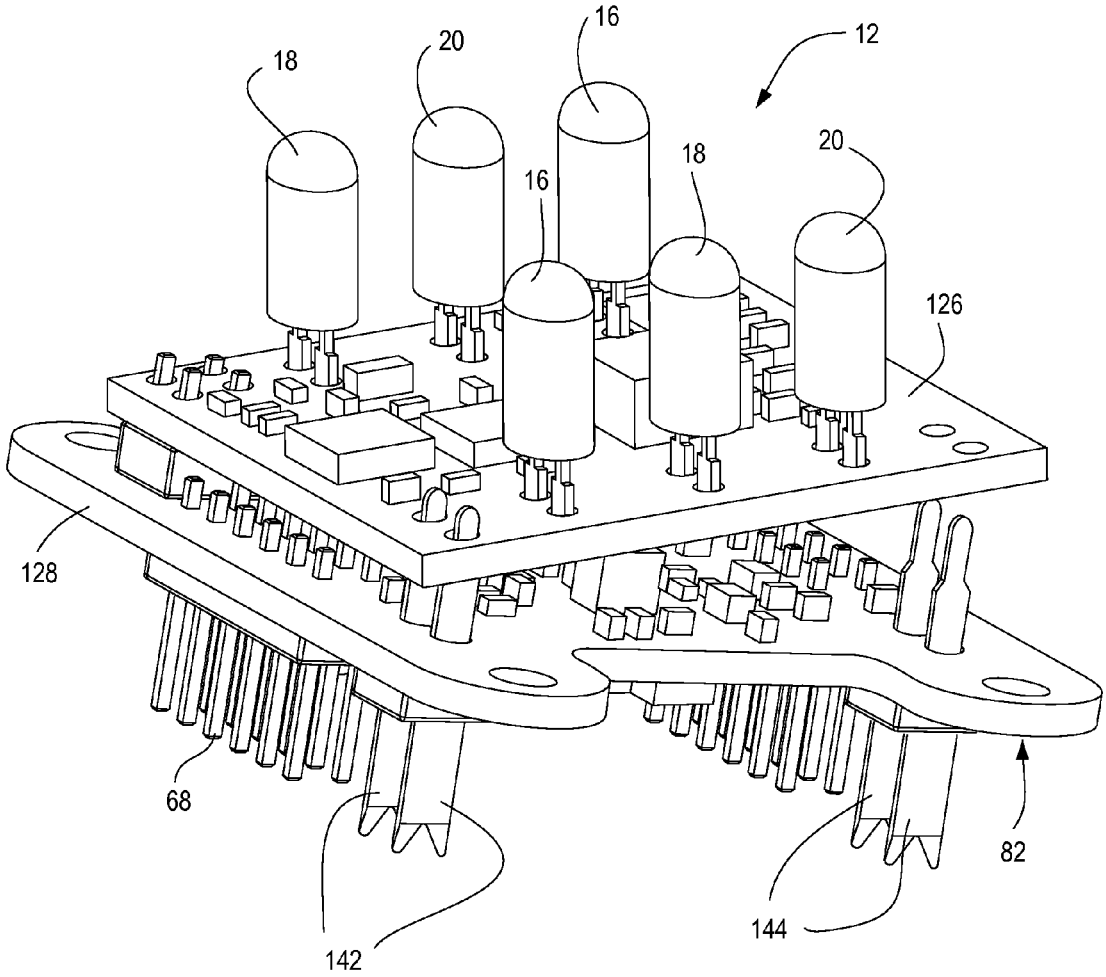
FIG. 10 is an illustration of the circuit boards and connectors for the master LED module depicted in FIG. 9.
Figure 11:
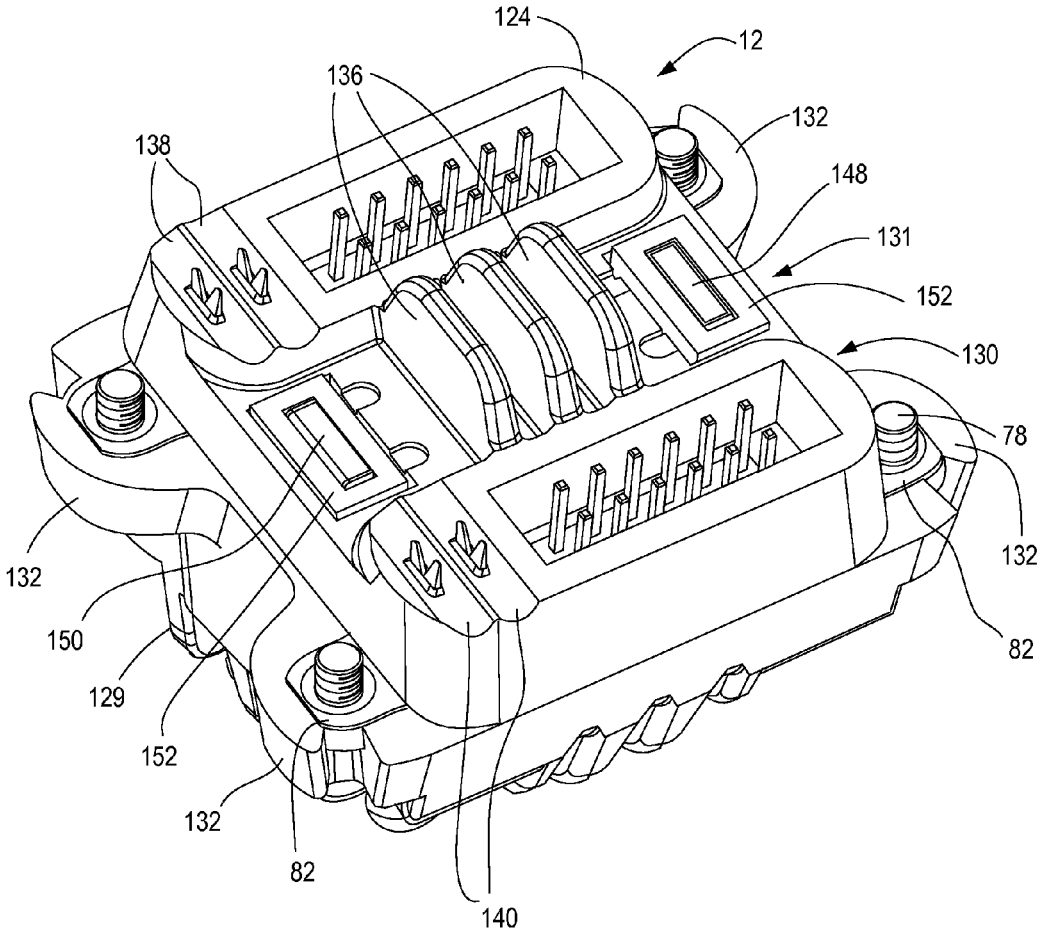
FIG. 11 is a back perspective view of the master LED module of FIG. 9.
Figure 12:
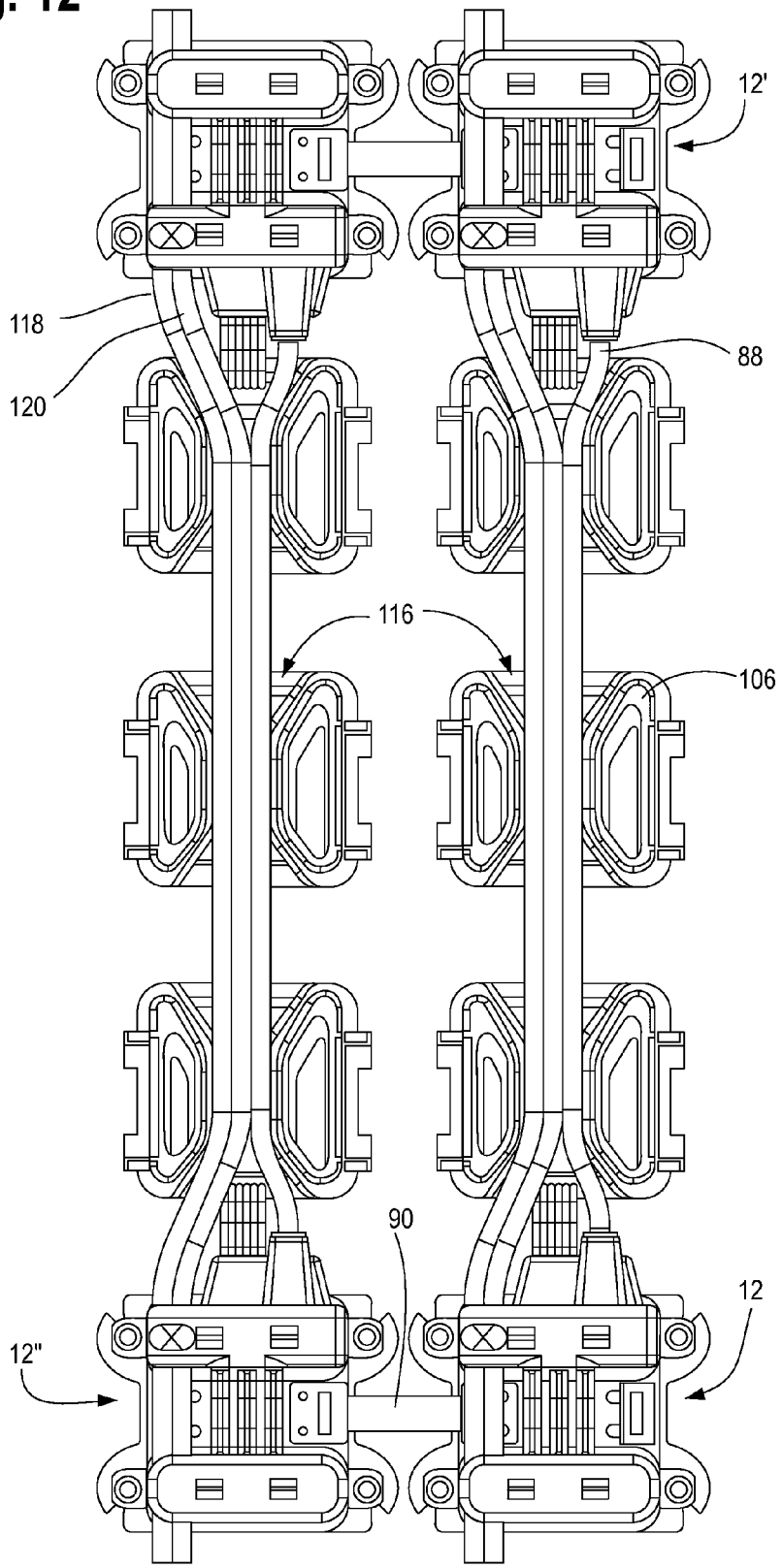
FIG. 12 is a back view of a pair of slave LED module segments connected between respective master LED modules.

Both the master LED modules 12 and the slave LED modules 14 are removably mounted on the respective back plates 42 and 44 so that the individual master LED modules 12 and/or a slave module segment 54 can be removed and replaced after the display 10 is installed. As seen in FIGS. 6-8, a slave module segment 54 includes a first electrical connector 56 that is fixedly attached to one end of the segment 54 and a second electrical connector 58 that is connected to a second end of the segment 54. A number of spaced slave LED modules 14 are connected between the first and second electrical connectors 56 and 58 via ribbon cables 60. The ribbon cables 60 carry power and data to each of the slave LED modules 14 of the segment 54 from a master module 12 that is connected to one of the electrical connectors 56.

As seen in FIGS. 7 and 8, each of the electrical connectors 56 and 58 of a slave module segment 54 includes a pair of downwardly extending rubber or elastomeric prongs 62 and 64. The prongs 62 of the electrical connector 56 snap through apertures 66 formed in the master LED module back plate 42. After the electrical connector 56 of the slave module segment 54 is snapped into the apertures 66 of a master module back plate 42, each of the slave modules of the segment 54 are snapped on to respective back plate 44. As a slave LED module 14 is snapped on to its back plate 44, a pair of module retaining members 72 are forced apart. When the slave module 14 is snapped into its back plate, the lower edge 73 of the retaining members 72 abuts the tops of a pair of protrusions 74 formed on the side walls of the slave LED module housing 100 to retain the slave module 14 securely on the back plate 44. The electrical connector 58 on the second end of the slave module segment 54 is inserted in apertures 67 of a master LED module back plate 42 in the next row of master modules. After the slave module segment 54 is mounted on the back plates of the cable support structure, a master LED module 12 is mounted on the back plate 42. Specifically, a master LED module 12 is mounted on the back plate 42 on top of the connector 56 with mating connector pins 68 of the module 12 extending into the apertures 70 of the electrical connector 56. Each of the master LED modules 12 is secured to a back plate 42 by four screws 78 that extend through apertures 80 of the back plate 42. In a preferred embodiment, the back plate 42 of the master LED modules is formed of steel or the like so that the back plate forms a heat sink that is in contact with the ground plane 82 of the printed circuit board 128 contained in the master LED module housing 124 as discussed in detail below. It is noted, that when the master LED module 12 is bolted onto the back plate 42, the over-molded elastomeric pads 86 of the electrical connector 56 are compressed so as to provide a water tight seal between the master LED module 12 and the electrical connector 56 of the slave module segment 54 to protect the connector from environmental effects.

The master LED module connected to the slave LED module segment 54 via the connector 56 provides data and power to the slave LED modules 14 of the segment 54 via the ribbon connector 60. A LVDS cable 88 that extends from the first electrical connector 56 and the second electrical connector 58 provides a direct electrical connection between a pair of master LED modules 12 and 12' of adjacent segments 24 in a column of the display 10 to allow the master LED modules of adjacent segments in a column to communicate directly as discussed in detail in the co-pending patent application Ser. No. 12/001,277 entitled "Data And Power Distribution System And Method For A Large Scale Display," filed concurrently herewith and incorporated herein by reference. Adjacent master LED modules 12 and 12" in a row of the display 10 communicate directly via a flex cable 90. In a preferred embodiment, the flex cable 90 overlies a H-link 34 connecting the support cables 32 and 30 as depicted in FIG. 2.

Each of the slave LED modules 14 includes a housing 100 that is over-molded about the slave module printed circuit board 102 on which the LEDs of the module are mounted and about a portion of the ribbon cables 60 connected to the printed circuit board 102 by a IDC connector 104. Each slave LED module is connected to the ribbon cable in a common-bus manner so that a failure of any connection does not affect the other slave modules. In order to over-mold the housings of the slave LED modules 14, a string of, for example, fifteen printed circuit boards 102 supporting the LEDs for respective slave modules are placed in a mold wherein the fifteen printed circuit boards are connected by respective ribbon connectors 60 in a string. Thereafter, a thermoset or thermoplastic resin is injected into the mold to form a casing or housing 100 about the printed circuit boards 102 and ribbon connectors 104. The over-molded housing of the LED modules provides extremely robust modules that can withstand harsh outdoor weather. Prior to injecting the resin to form the housing 100 of the slave LED modules 14, a flash memory contained on the circuit board 102 is programmed with the address of the slave LED module. For a slave module segment 54 having fifteen slave LED modules, the slave modules will have an address of 1 to 15 starting in sequence with the slave LED module that is closest to the electrical connector 56 to be attached to the master LED module that will control the slave modules in a segment 24 of the display. It is noted that, while the printed circuit boards are in the molding fixture, the electronics on the boards 102 can be tested prior to over-molding. It is noted, that the mold for the slave LED module housings supports the printed circuit board 102 for the LEDs at a 10° angle from the back surface 106 of the housing. As such, when the slave LED module segment 54 is mounted vertically, the LEDs are angled downward by 10° for better viewing of the pixels generated by the slave modules when the display is in use. It should be appreciated, however, that the angle of the LEDs can be 0° to 20° where the LEDs are angled up, down or to the side depending upon the use of the display.

Each of the housings 100 for the slave LED modules 14 has integrally formed heat sink fins on a front surface of the housing between a first column 112 of red, green and blue LEDs and a second column 114 of red, green and blue LEDs. Placing the heat sink fins 108 between the LEDs of the module, which are actuated to form a single pixel, does not interfere with the light generated by the LEDs to form the pixel. It is noted, in a preferred embodiment, the LEDs in the first column have an order of red, green and blue; whereas the LEDs in the second column have an order of green, blue and red so as to provide better color mixing to generate the various colors of a pixel.

Each of the housings 100 for the slave LED modules 14 also has integrally formed sunshades 110 that project outwardly above each of the LEDs 16, 18 and 20. It is noted, that in an alternate embodiment that does not have the heat sink fins 108 on the front surface of the housing 100, one sunshade 110 may be positioned above each row of LEDs. The sunshades 110 as well as the black or dark resin used to form the housing 100 of the LEDs enhances the contrast or conspicuity of the pixels generated by the modules 14 when the display 10 is used outdoors.

As shown in FIG. 8, the housing 100 of each of the slave LED modules 14 is molded so as to form a channel 116 in the back surface 106 of the housing 100. The channel 116 is sufficiently wide so as to be able to accommodate the cable 88 therein as well as a pair of power cables 118 and 120. The channels 116 of the housings 100 are aligned with the ribbon cables 60 so that the LVDS cable 88 and the power cables 118 and 120 are aligned in back of the ribbon cables 60. Thus, when viewed from the front of the display 10, the cables 88, 118 and 120 are not readily visible. Further, because the cables 88, 118 and 120 are aligned behind the ribbon cables 60, the display still has open areas between the modules so that if the display 10 is hung in an open area outdoors, there is relief for wind. Moreover, the open areas permit viewing through the display. Such a semi-transparent display will not block the view out of windows of a building upon which the display is hung.

The housing 124 for each of the master LED modules is over-molded about the master module printed circuit boards 126 and 128. The LEDs 16, 18 and 20 for the master module 12 are mounted on the printed circuit board 126 which is similar to the printed circuit board 102 of the slave LED modules for controlling the illumination of the LEDs of a module. The printed circuit board 128 of the master LED module includes additional circuitry for controlling the functions of the master LED module that are unique thereto, such as extracting the data intended for the master module and its associated slave LED modules in a segment 24 of the display as described in the co-pending patent application Ser. No. 12/001,277, entitled "Data and Power Distribution. System And Method For A Large Scale Display," filed Dec. 11, 2007 and incorporated herein by reference. In a preferred embodiment, the printed circuit board 126 is soldered to the circuit board 128 at a 10° angle so that when the boards 126 and 128 are placed in the mold for the master LED module housing 124, the LEDs 16, 18 and 20 will be at a 10° angle to the back surface 130 of the module 12 as described above for the LEDs of the slave module 14.

The front surface of the housing 124 for each of the master LED modules 12 is the same as the front surface of the housing 100 for the slave LED modules 110 so that both types of modules have the same LED order, the same heat sink fins 108 and the same sunshades 110, providing a uniform appearance of pixels throughout the display regardless of whether they are generated by a master or a slave module. However, the sides and the back surface 130 of the master LED module housing 124 are different than those of the housing 100 for the slave modules 102. In particular, the sides 129 and 131 of the master module housing 124 are formed with projections 132 having apertures 134 therein for the screws 78 that attach the master LED module 12 to the back plate 42 of the master LED module. The back surface 130 of the master LED module housing 124 includes a number of integrally formed heat sinks 136 so as to further aid in the heat dissipation of the master module. It is noted that the housings for the master LED modules as well as the housings for the slave LED modules are over-molded with a thermally conductive resin. The resin conducts heat away from components and the geometry of the housing spreads the heat and provides a maximized surface area for heat transfer. Moreover, the back plate 42 is thermally and electrically connected to the ground plane on the master LED module's printed circuit board to allow the back plate 42 to act as an additional and independent heat sink for the master LED module.

The back surface 130 of the housing 124 of the master LED module 12 is also formed with two pairs of grooves 138 and 140 through which power cable connectors 142 and 144 extend. When power cables 118 and 120 are seated in the grooves 138 and 140 of the housing 124, the prongs of the connectors 142 and 144, pierce the rubber insulation of the power cables so as to make electrical contact with the cables. The power cables are continuous and the insulation piercing connectors 142 and 144 are formed with sharp prongs to minimize the force required to penetrate the rubber insulation on the cables. The preferred insulation is a thermoplastic elastomer because of its resilience and toughness. This insulation tends to close around the penetrating prongs forming a seal. It is noted that when the screws 78 that attach a master LED module 12 to a back plate 42 are tightened, the prongs of the connectors 142 and 143 are driven into the power cables. A redundant set of power connections are provided for the master LED modules so that there are two positive and two neutral connections spread apart as far as possible such that the system is tolerant to a connection failure. The master LED module 12 also includes Z-axis connectors 148 and 150 surrounded by elastomeric pads 152. These connectors are commercially available flexible connectors that are designed to conduct along a single Z-axis. The back plate 42 compresses the Z-axis connector between contacts on the printed circuit board 128 and contacts on the flex circuit 90. The flex circuit 90 is designed as a stripline circuit with conductors and conductor spacing adjusted to achieve the desired impedance (75 ohms). The stripline configuration also provides shielding for the data conductors. The Z-axis connectors connect to the flex cables 90 so as to allow adjacent master LED modules 12 in a row of a display panel to communicate directly as discussed above.

In accordance with a preferred embodiment of the present invention, the display 10 is arranged in a number of panels for easy deployment. Each panel, may have, for example, sixteen columns wherein a full height panel has 480 rows, although, each of the display panels can have any height and width desired. The support cables, 24, 26, 30, 32, 36 and 40 for the LED modules of each display panel are attached to a steel bar 60 wherein each of the steel bars 160 of a display 10 are clamped together to support the multiple display panels forming the display 10. The steel bar 160 is then attached to a support structure 162 162 which is used to hoist the display 10 on to a support structure such as a building or frame. Each of the display panels forming the display 10 includes a data hub 164 that provides the video data to the display panel of the display 10. Power to the display panel 10 may also be provided to the display 10 through the data hubs 164 so that the data hubs can monitor the power supply. Details of the data hubs and power hubs for the display 10 are disclosed in the co-pending patent application Ser. No. 12/001,277, entitled "Data And Power Distribution System And Method For A Large Scale Display," filed Dec. 11, 2007 and incorporated herein by reference.

The large scale LED display of the present invention is extremely robust, readily repairable and suitable for outdoor as well as indoor use. Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A LED module for a display, comprising:
a plurality of LEDs;
a circuit board on which the LEDs are mounted; and
an over-molded housing encasing the circuit board inside the housing, wherein:
the LEDs protrude through a front surface of the housing;
if the LED module is a slave module in the display, at least one channel is formed on a back surface of the housing for one or more cables that are not connected to the LED module to pass through in the channel, and the one or more cables directly connect two master modules in the display while passing through the LED module;
if the LED module is a master module which controls a corresponding group of slave modules in the display, a plurality of heat sinks are integrally formed on the back surface of the housing to aid in heat dissipation of the LED module; and
the LED module is either a master module or a slave module in the display.

2. The LED module according to claim 1, wherein the housing is formed of a black resin.

3. The LED module according to claim 1, wherein the LEDs are arranged in at least two columns, each column having a red LED, a green LED and a blue LED wherein the columns are separated by one or more heat sink fins on the front surface of the housing.

4. The LED module according to claim 1, wherein the LEDs are arranged in columns including a first column having an order of red, green and blue LEDs and a second column having an order of green, blue and red LEDs.

5. The LED module according to claim 4, wherein the first and second columns of LEDs are separated by one or more heat sink fins on the front surface of the housing.

6. The LED module according to claim 1, wherein the front surface of the housing includes a plurality of sunshade protrusions, each protrusion extending outwardly above one or more of the LEDs of the module.

7. The LED module according to in claim 6, wherein each LED has an individual sunshade protrusion extending outwardly above the LED.

8. The LED module according to claim 1, wherein the LEDs comprise one or more red LEDs, one or more green LEDs and one or more blue LEDs.

9. The LED module according to claim 1, wherein the front surface of the housing includes a plurality of heat sink fins that are disposed between the LEDs of the LED module.

10. The LED module according to claim 1, wherein the LEDs are angled by a particular angle upward, downward or to a side depending upon a use of the display.

11. The LED module according to claim 10, wherein the particular angle is between 0° and 20°.

12. The LED module according to claim 1, wherein the LEDs are angled downward by 10° when the display is in use.

13. The LED module according to claim 1, wherein the one or more cables comprise at least one low-voltage differential signaling (LVDS) cable that is not connected to the LED module.

14. The LED module according to claim 1, wherein the one or more cables comprise one or more power cables that are not connected to the LED module.

15. The LED module according to claim 1, wherein the housing is over-molded with a thermally conductive resin.

16. The LED module according to claim 1, wherein a color of the housing matches a particular color of a structure on which the display is mounted.

17. The LED module according to claim 1, wherein a color of the housing of the LED module matches a particular color so that when all LEDs of the display are turned off, the particular color along with housing colors of other LED modules of the display depict a fixed logo.

18. The LED module according to claim 1, wherein a color of the housing of the LED module matches a particular color so that when all LEDs of the display are turned off, the particular color along with housing colors of other LED modules of the display depict one or both of a graphic and a text message.

19. A LED module for a display, comprising:
a plurality of LEDs;
a circuit board on which the LEDs are mounted; and
an over-molded housing encasing the circuit board inside the housing, wherein:
the LEDs protrude through a front surface of the housing, and the front surface of the housing includes a first plurality of heat sink fins that are disposed between the LEDs of the LED module;
if the LED module is a slave module in the display, at least one channel is formed on a back surface of the housing for one or more cables that are not connected to the LED module to pass through in the channel, and the one or more cables directly connect two master modules in the display while passing through the LED module;
if the LED module is a master module which controls a corresponding group of slave modules in the display, a second plurality of heat sinks are integrally formed on the back surface of the housing to further aid in heat dissipation of the LED module; and
the LED module is either a master module or a slave module in the display.

20. A LED module for a display, comprising:
a plurality of LEDs which comprise one or more red LEDs, one or more green LEDs and one or more blue LEDs;
a circuit board on which the LEDs are mounted; and
an over-molded housing encasing the circuit board inside the housing, wherein:
the LEDs protrude through a front surface of the housing, and the front surface of the housing includes a first plurality of heat sink fins that are disposed between the LEDs of the LED module;

if the LED module is a slave module in the display, at least one channel is formed on a back surface of the housing for one or more cables that are not connected to the LED module to pass through in the channel, and the one or more cables directly connect two master modules in the display while passing through the LED module;

if the LED module is a master module which controls a corresponding group of slave modules in the display, a second plurality of heat sinks are integrally formed on the back surface of the housing to further aid in heat dissipation of the LED module; and the LED module is either a master module or a slave module in the display.

* * * * *